US010910745B2

(12) United States Patent
Hosoda

(10) Patent No.: US 10,910,745 B2
(45) Date of Patent: Feb. 2, 2021

(54) CIRCUIT BOARD CONNECTOR APPARATUS

(71) Applicant: HIROSE ELECTRIC CO., LTD., Tokyo (JP)

(72) Inventor: Shohei Hosoda, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/742,093

(22) Filed: Jan. 14, 2020

(65) Prior Publication Data

US 2020/0235506 A1 Jul. 23, 2020

(30) Foreign Application Priority Data

Jan. 22, 2019 (JP) ..... 2019-008431

(51) Int. Cl.
*H01R 12/70* (2011.01)
*H01R 12/71* (2011.01)
*H01R 13/631* (2006.01)

(52) U.S. Cl.
CPC ..... *H01R 12/718* (2013.01); *H01R 13/631* (2013.01)

(58) Field of Classification Search
CPC .. H01R 12/718; H01R 13/631; H01R 13/504; H01R 12/712; H01R 12/716; H01R 24/60
USPC ..... 439/78, 74, 66
See application file for complete search history.

(56) References Cited

U.S. PATENT DOCUMENTS 7,172,434 B2 * 2/2007 Obikane ..... H01R 24/60 439/570
7,722,408 B2 * 5/2010 Miyazaki ..... H01R 12/716 439/660
8,845,339 B2 * 9/2014 Ono ..... H01R 12/712 439/74
8,992,234 B2 * 3/2015 Yoshioka ..... H01R 12/7029 439/74
9,362,637 B2 * 6/2016 Hasegawa ..... H01R 12/716
9,391,398 B2 * 7/2016 Omodachi ..... H01R 12/716
9,590,327 B2 * 3/2017 Matsuno ..... H01R 12/7005
9,666,963 B2 * 5/2017 He ..... H01R 12/7088
(Continued)

FOREIGN PATENT DOCUMENTS

JP 2017-168210 A 9/2017

*Primary Examiner* — Harshad C Patel
(74) *Attorney, Agent, or Firm* — Rankin, Hill & Clark LLP

(57) ABSTRACT

A circuit board connector apparatus includes a housing, a terminal, and a reinforcing fitting. The housing includes a protruding wall that protrudes in a height direction, a peripheral wall that protrudes in the height direction and surrounds the perimeter of the protruding wall, and a receiving portion between the protruding wall and the peripheral wall, the receiving portion being recessed in the height direction. The reinforcing fitting includes a first and a second portion extending toward the terminal along at least a length portion of the peripheral wall in a state of each being connected to an end portion placed in a width portion of the peripheral wall and in a state of being spaced apart in the height direction from each other. The second portion is located on a side closer in the height direction to a mounting surface than the first portion, and at the same position as an outer end of the first portion, or inward of the outer end in the housing, in a width direction.

19 Claims, 9 Drawing Sheets

(56) References Cited

U.S. PATENT DOCUMENTS

| | | | | |
|---|---|---|---|---|
| 9,899,771 | B2 * | 2/2018 | Ashibu | H01R 12/716 |
| 9,997,852 | B2 * | 6/2018 | Chen | H01R 12/716 |
| 10,003,148 | B2 * | 6/2018 | Ashibu | H01R 13/2407 |
| 10,249,969 | B2 * | 4/2019 | Ono | H01R 13/504 |
| 10,396,484 | B2 * | 8/2019 | Chen | H01R 12/7088 |
| 10,651,579 | B2 * | 5/2020 | Ono | H01R 13/631 |
| 10,680,362 | B2 * | 6/2020 | Yoshioka | H01R 12/716 |
| 10,756,466 | B2 * | 8/2020 | Ono | H01R 13/504 |
| 2006/0264075 | A1 * | 11/2006 | Obikane | H01R 24/60 439/74 |
| 2013/0280926 | A1 * | 10/2013 | Ono | H01R 12/7052 439/65 |
| 2017/0264048 | A1 | 9/2017 | Ashibu et al. | |

* cited by examiner

CIRCUIT BOARD CONNECTOR APPARATUS

CROSS-REFERENCE TO RELATED APPLICATION

This application claims priority from Japanese Patent Application No. 2019-008431 filed with the Japan Patent Office on Jan. 22, 2019, the entire content of which is hereby incorporated by reference.

BACKGROUND

1. Technical Field

An aspect of the present disclosure relates to a circuit board connector apparatus.

2. Related Art

JP-A-2017-168210 discloses a circuit board electrical connector being an example of a circuit board connector apparatus that is mounted on a mounting surface of a circuit board. The circuit board electrical connector includes a holding member made of resin, a plurality of contacts held by the holding member, two reinforcing members assembled into the holding member, and two guide members. Each guide member is integral with its corresponding reinforcing member. The guide members, together with the reinforcing members, are assembled into the holding member by insert molding.

The holding member includes a housing portion, a land portion, and a surrounding portion. The housing portion houses part of a counterpart connector when the counterpart connector approaches from above the connector in the up-and-down direction and both connectors mate with each other. The land portion is placed in the housing portion, and protrudes upward in the up-and-down direction. The surrounding portion surrounds the land portion via the housing portion.

A longitudinal direction of the land portion is a first horizontal direction orthogonal to the up-and-down direction. The land portion includes first contact portion housing portions arranged in the first horizontal direction, at either end in a second horizontal direction orthogonal to both of the up-and-down direction and the first horizontal direction. A first contact portion of the contact is housed in the first contact portion housing portion.

A longitudinal direction of the surrounding portion is the first horizontal direction orthogonal to the up-and-down direction. The surrounding portion includes second contact portion housing portions arranged in the first horizontal direction, at either end in the second horizontal direction orthogonal to both of the up-and-down direction and the first horizontal direction. A second contact portion of the contact is housed in the second contact portion housing portion. The first and second contact portions are placed in such a manner as to face each other in the second horizontal direction.

The reinforcing members are located respectively at two end portions of the land portion in the first horizontal direction, and extend into the land portion. The reinforcing member includes a protective portion that protects the land portion. The protective portion includes an exposed connecting portion, support portions, lower exposed portions, and elastic pieces. The exposed connecting portion extends downward in the up-and-down direction from a top surface. Each support portion extends along the second horizontal direction from the top surface, and branches in a direction away from the land portion. The lower exposed portion is connected to the support portion. The elastic piece is connected to the lower exposed portion.

The guide member includes a first guide portion, two second guide portions, and connecting portions. The first guide portion faces the protective portion of the reinforcing member in the first horizontal direction. The two second guide portions are located across the housing portion of the holding member from each other in the second horizontal direction. The connecting portion extends downward from an upper end of the first guide portion and connects the guide member and the reinforcing member. An upper end of the second guide portion of the guide member is connected to the upper end of the first guide portion. Moreover, the second guide portion is configured in such a manner as to be soldered to the circuit board (not illustrated) via a lower end, which is formed as a free end, of the second guide portion connected to the upper end.

SUMMARY

A circuit board connector apparatus includes: a housing including a height direction, a length direction, and a width direction, which are orthogonal to each other; and a terminal and a reinforcing fitting, which are held by the housing. The housing includes: a protruding wall protruding in the height direction from a side of a mounting surface of a circuit board where the circuit board connector apparatus is mounted toward a side mating with a counterpart connector; a peripheral wall including a length portion extending along the length direction, and a width portion extending along the width direction, the peripheral wall protruding in the height direction from the mounting surface side toward the side mating with the counterpart connector, the peripheral wall surrounding a perimeter of the protruding wall; and a receiving portion between the protruding wall and the peripheral wall in the length direction and the width direction, the receiving portion being recessed in the height direction from the side mating with the counterpart connector toward the mounting surface side, the reinforcing fitting includes a first and a second portion extending toward the terminal along at least the length portion of the peripheral wall in a state of each being connected to an end portion placed in the width portion of the peripheral wall and in a state of being spaced apart in the height direction from each other, the first portion is exposed from the housing on the side mating with the counterpart connector in the height direction, the second portion on a side opposite to the side mating with the counterpart connector in the height direction is mounted on the mounting surface of the circuit board, and the second portion is located on a side closer in the height direction to the mounting surface than the first portion, and at the same position as an outer end of the first portion, or inward of the outer end in the housing, in the width direction.

DETAILED DESCRIPTION

Figure 1:
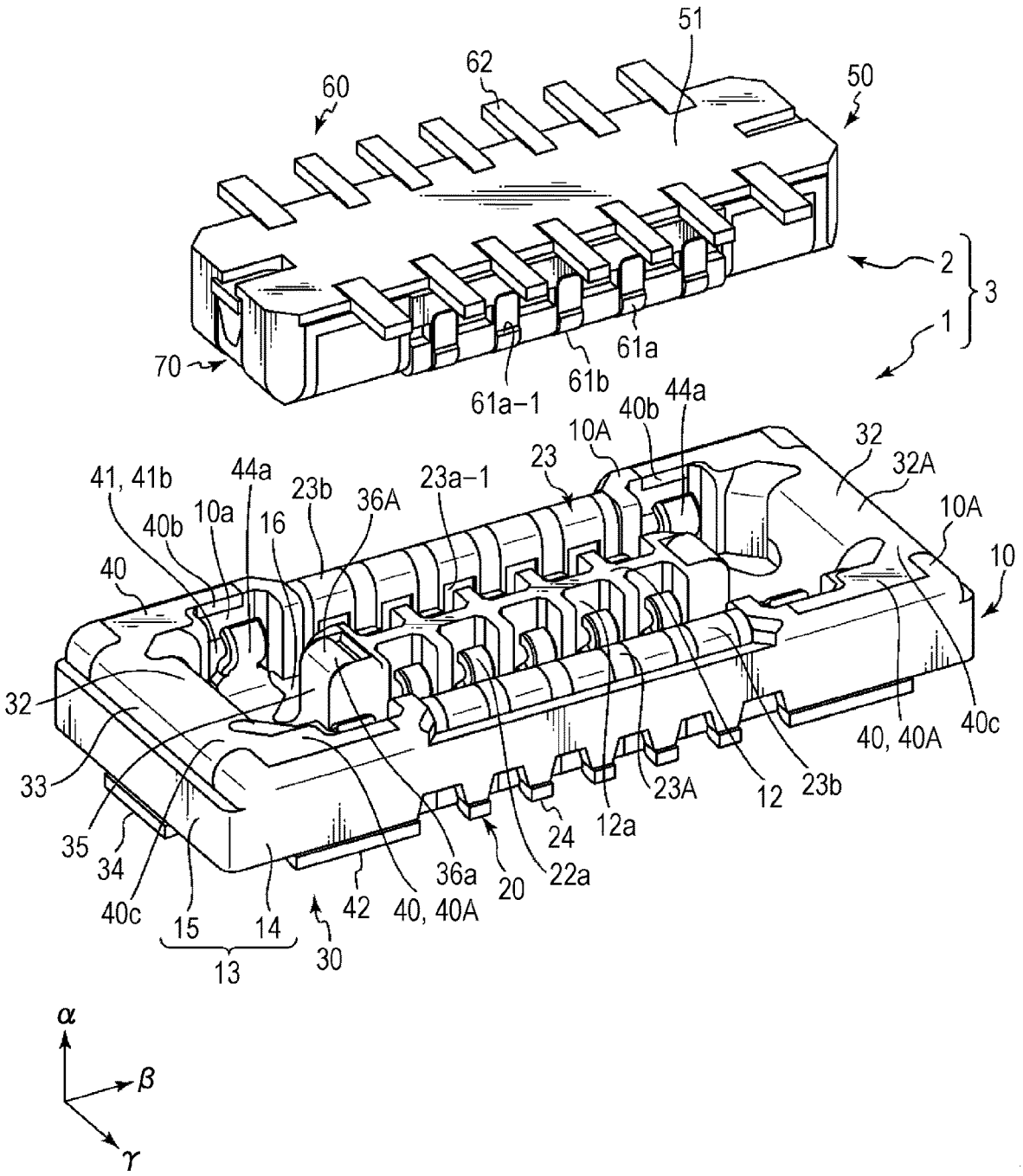
FIG. 1 is a perspective view illustrating an example of a connector apparatus assembly according to one embodiment of the present disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In the circuit board electrical connector of JP-A-2017-168210, the lower end, which is soldered to the circuit board (not illustrated), of the second guide portion of the guide member extending in the second horizontal direction is formed by bending an end portion in the second horizontal direction forming the upper end of the second guide portion perpendicularly along the up-and-down direction. As a result, the connector results in upsizing in the second horizontal direction accordingly by at least the thickness of the guide member.

Moreover, in the connector of JP-A-2017-168210, the elastic piece, which comes into contact with the counterpart connector upon mating with the counterpart connector, of the reinforcing member reaches the land portion in the first horizontal direction. As a result, the connector also results in upsizing in the first horizontal direction accordingly by the arrangement of the elastic pieces of the reinforcing member in addition to the terminals.

Furthermore, in the connector of JP-A-2017-168210, the guide member protrudes toward a side that mates with the counterpart connector as compared to the terminal. Hence, the connector also results in upsizing in the up-and-down direction accordingly.

Moreover, in the connector of JP-A-2017-168210, the top surface of the reinforcing member that protects the land portion is formed narrower in the second horizontal direction than the guide member. Furthermore, the elastic piece, which can come into contact with the counterpart connector upon mating with the counterpart connector, of the reinforcing member is provided, branching away from this narrow top surface. Consequently, heat is easily generated at the narrow top surface and the elastic piece. As a result, noise tends to occur in a high-frequency signal.

One object of the present disclosure is to provide a circuit board connector apparatus that can prevent upsizing of a connector at least in the second horizontal direction.

A circuit board connector apparatus according to an aspect of the present disclosure (this circuit board connector apparatus) includes: a housing including a height direction, a length direction, and a width direction, which are orthogonal to each other; and a terminal and a reinforcing fitting, which are held by the housing. The housing includes: a protruding wall protruding in the height direction from a side of a mounting surface of a circuit board where the circuit board connector apparatus is mounted toward a side mating with a counterpart connector; a peripheral wall including a length portion extending along the length direction, and a width portion extending along the width direction, the peripheral wall protruding in the height direction from the mounting surface side toward the side mating with the counterpart connector, the peripheral wall surrounding a perimeter of the protruding wall; and a receiving portion between the protruding wall and the peripheral wall in the length direction and the width direction, the receiving portion being recessed in the height direction from the side mating with the counterpart connector toward the mounting surface side, the reinforcing fitting includes a first and a second portion extending toward the terminal along at least the length portion of the peripheral wall in a state of each being connected to an end portion placed in the width portion of the peripheral wall and in a state of being spaced apart in the height direction from each other, the first portion is exposed from the housing on the side mating with the counterpart connector in the height direction, the second portion on a side opposite to the side mating with the counterpart connector in the height direction is mounted on the mounting surface of the circuit board, and the second portion is located on a side closer in the height direction to the mounting surface than the first portion, and at the same position as an outer end of the first portion, or inward of the outer end in the housing, in the width direction.

Moreover, a connector apparatus assembly (the connector apparatus assembly) according to one aspect of the present disclosure includes a pair of the circuit board connector apparatus, and the counterpart connector that mates with the circuit board connector apparatus.

According to the circuit board connector apparatus and the connector apparatus assembly, it is possible to prevent upsizing of a connector at least in the width direction.

In the circuit board connector apparatus, the end portion includes: an external wall portion forming an external wall of the width portion of the peripheral wall; an internal wall portion forming an internal wall of the width portion of the peripheral wall, the internal wall portion facing the receiving portion; and an upper wall portion joining the external wall portion and the internal wall portion on the side mating with the counterpart connector in the height direction, and the upper wall portion is exposed from the housing on the side mating with the counterpart connector in the height direction.

Moreover, in the circuit board connector apparatus, the first portion extends from the upper wall portion, and the second portion extends from the external wall portion.

Further, in the circuit board connector apparatus, a top portion, which is located on a side closest in the height direction to the counterpart connector, of the upper wall portion is positioned at the same height in the height direction as a top portion, which is located on the side closest in the height direction to the counterpart connector, of the first portion.

Further, in the circuit board connector apparatus, the second portion may include a surface formed in such a manner as to extend in the height direction and the length direction, and at least a part of the surface may be exposed from the housing on the receiving portion side.

In the circuit board connector apparatus, at least a part of a surface of the second portion, the part being exposed from the housing, an inner end of the first portion, and a part of the housing provided between the part and the inner end may form the same surface along the height direction on the receiving portion side.

Moreover, in the circuit board connector apparatus, the reinforcing fitting may further includes: a bottom portion forming a part of a bottom wall of the receiving portion; an end wall extending along the longitudinal direction from the bottom portion, the end wall protruding in the height direction toward the side mating with the counterpart connector, the end wall forming a part of an external wall of the protruding wall; and a bent portion on a side opposite to the bottom portion of the end wall.

In the circuit board connector apparatus, the bent portion may form a top portion, which is located on a side closest in the height direction to the counterpart connector, of the protruding wall.

Further, in the circuit board connector apparatus, it is preferred that an end portion of the bent portion is embedded in the protruding wall.

Moreover, in the circuit board connector apparatus, a part of the terminal may be exposed from the length portion of the housing on the side mating with the counterpart connector in the height direction, and a top portion, which is located on a side closest in the height direction to the counterpart connector, of the terminal in the exposed part of the terminal is positioned at the same height in the height direction as a top portion of the bent portion and a top portion of the first portion, the top portions being located on the side closest in the height direction to the counterpart connector.

Further, in the circuit board connector apparatus, an elastic contact portion of the terminal may be positioned between the counterpart connector and the protruding wall in such a manner as to be able to come into elastic contact with the counterpart connector upon mating with the counterpart connector.

In the circuit board connector apparatus, the reinforcing fitting may further include: a bottom portion forming a part of a bottom wall of the receiving portion; and an elastic contact portion extending along the width direction from the bottom portion, the elastic contact portion protruding in the height direction toward the side mating with the counterpart connector, and the elastic contact portion may be positioned between the counterpart connector and the peripheral wall in such a manner as to be able to come into elastic contact with the counterpart connector upon mating with the counterpart connector.

In the circuit board connector apparatus, it is preferred that a top portion, which is located on a side closest in the height direction to the counterpart connector, of the elastic contact portion is located on a side closer to the mounting surface than a top portion, which is located on the side closest in the height direction to the counterpart connector, of the first portion.

Moreover, in the circuit board connector apparatus, it is preferred that the second portion includes an exposed surface formed in such a manner as to extend in the height direction and the length direction, the exposed surface being exposed from the housing on the receiving portion side, and the elastic contact portion is placed in such a manner as to face the exposed surface of the second portion in the width direction.

Further, the circuit board connector apparatus, it is preferred that the exposed surface and the elastic contact portion each include a portion overlapping each other in the length direction.

Further, in the circuit board connector apparatus, a top portion, which is located on a side closest in the height direction to the counterpart connector, of the first portion is positioned at the same height in the height direction as a top portion, which is located on the side closest in the height direction to the counterpart connector, of the housing.

Furthermore, in the circuit board connector apparatus, the terminal and the reinforcing fitting may be integrally molded with the housing.

Moreover, in the circuit board connector apparatus, the reinforcing fitting may be formed, using one plate-shaped metal sheet.

According to the circuit board connector apparatus and the connector apparatus assembly, a circuit board connector apparatus is provided which can prevent upsizing of the connector at least in a second horizontal direction (width direction).

One preferred embodiment of the present disclosure is described hereinafter with reference to the accompanying drawings. For convenience of description, only the preferred embodiment is illustrated. Naturally, however, it does not limit the technology of the present disclosure.

Figure 2:
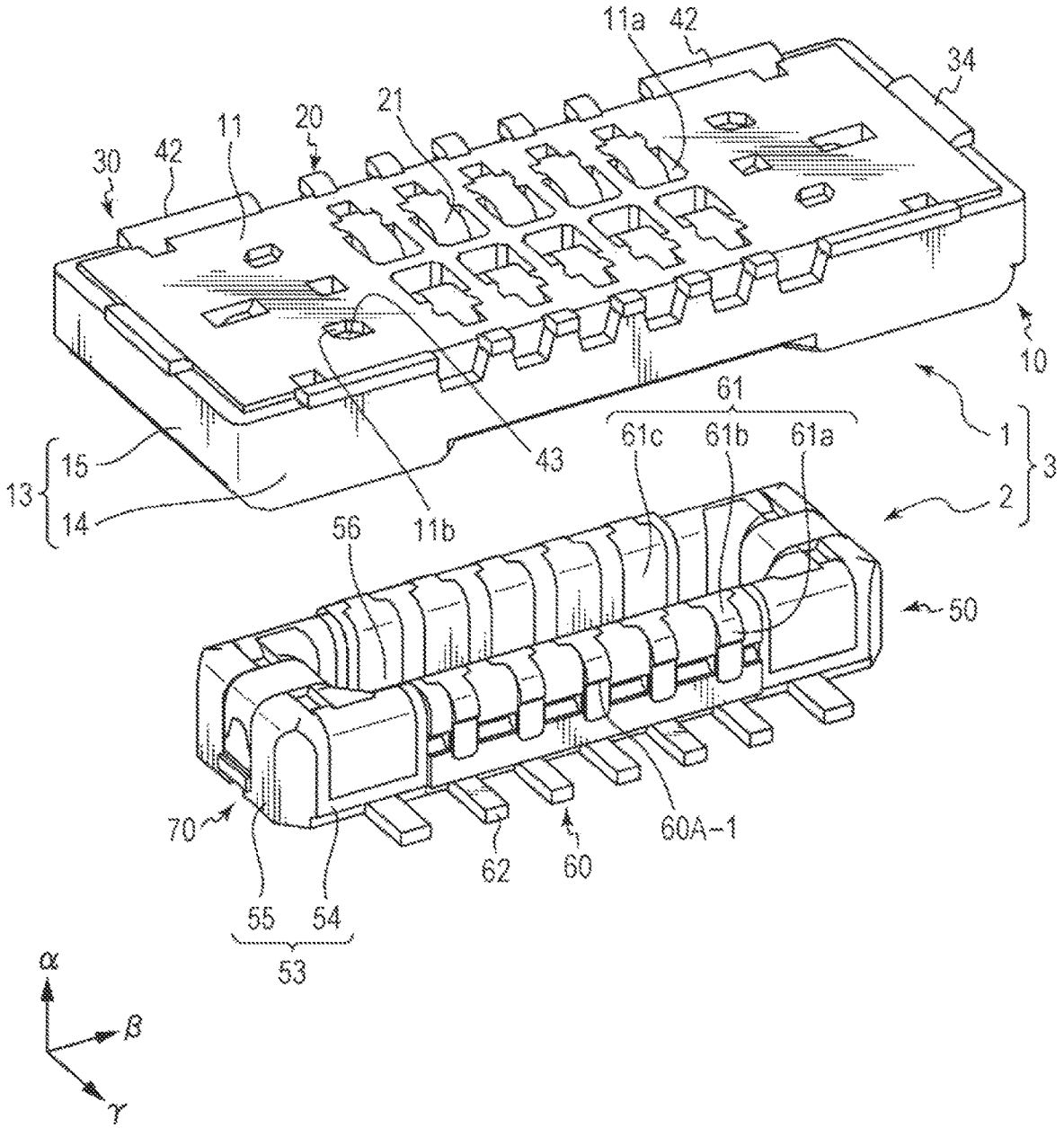
FIG. 2 is a perspective view illustrating an example of the connector apparatus assembly according to one embodiment of the present disclosure.

FIGS. 1 and 2 are perspective views illustrating an example of a connector apparatus assembly 3 according to one embodiment of the present disclosure. The connector apparatus assembly 3 includes a pair of a receptacle connector (circuit board connector apparatus) 1 according to one embodiment of the present disclosure, and a plug connector 2 being a counterpart connector that mates with the receptacle connector 1. FIG. 1 illustrates the receptacle connector 1 on the lower side, and the plug connector 2 on the upper side. FIG. 2 illustrates the receptacle connector 1 on the upper side, and the plug connector 2 on the lower side.

The receptacle connector 1 and the plug connector 2 are circuit board connector apparatuses that are mounted on mounting surfaces of different circuit boards (not illustrated), respectively. The receptacle connector 1 and the plug connector 2 can mate with, or demate from, each other by being moved along an illustrated arrow "α" with respect to the mounting surfaces of the circuit boards. Each of the receptacle connector 1 and the plug connector 2 has a symmetrical shape in a length direction "β" orthogonal to the direction "α" along a connector mating direction, and a width direction "γ" orthogonal to the "α" and "β" directions. However, provided they do not contradict the spirit of the technology of the present disclosure, the receptacle connector 1 and the plug connector 2 may each have an asymmetrical portion in the above directions.

The receptacle connector 1 includes a substantially flat rectangular housing 10 made of resin, and terminals 20 and reinforcing fittings 30, which are held by the housing 10. The holding of the terminals 20 and the reinforcing fittings 30 by the housing 10 may be holding by integration or press fitting, or preferably holding by integral molding (insert molding). In the embodiment, the terminals 20 and the reinforcing fittings 30 are held by the housing 10 by integral molding (insert molding).

The housing 10 has the height direction "α", the length direction "β", and the width direction "γ", which are orthogonal to each other. The height direction "α" is along the above-mentioned connector mating direction. These terms are simply terms for distinguishing the directions for convenience, and do not indicate their lengths.

The housing 10 mainly includes a bottom wall 11, a substantially cuboid protruding wall 12, a box-shaped peripheral wall 13, and a receiving portion 16. The bottom wall 11 is placed on the mounting surface where the circuit board is mounted. The protruding wall 12 protrudes in the height direction "α" from the bottom wall 11 toward a side, which mates with the plug connector 2, of the receptacle connector 1. The side, which mates with the plug connector 2, of the receptacle connector 1 may be expressed below as the side mating with the plug connector 2.

The peripheral wall 13 protrudes in the height direction "α" from the mounting surface side toward the side mating with the plug connector 2. The peripheral wall 13 surrounds the perimeter of the protruding wall 12 in the length direction "β" and the width direction "γ". The receiving portion 16 is located between the protruding wall 12 and the peripheral wall 13 in the length direction "β" and the width direction "γ". The receiving portion 16 is recessed in the height direction "α" from the side mating with the plug connector 2 toward the mounting surface side. The peripheral wall 13 includes two side walls ("length portions" in the claims 14, and two end walls ("width portions" in the claims 15. The side walls 14 face each other in the width direction "γ", and extend parallel along the length direction "β". Similarly, the end walls 15 face each other in the length direction "β", and extend parallel along the width direction "γ". Groove portions 12A that each house part of the terminal 20 are formed in the protruding wall 12 all over the protruding area of the protruding wall 12 in such a manner as to be open at the upper part.

Figure 3A:
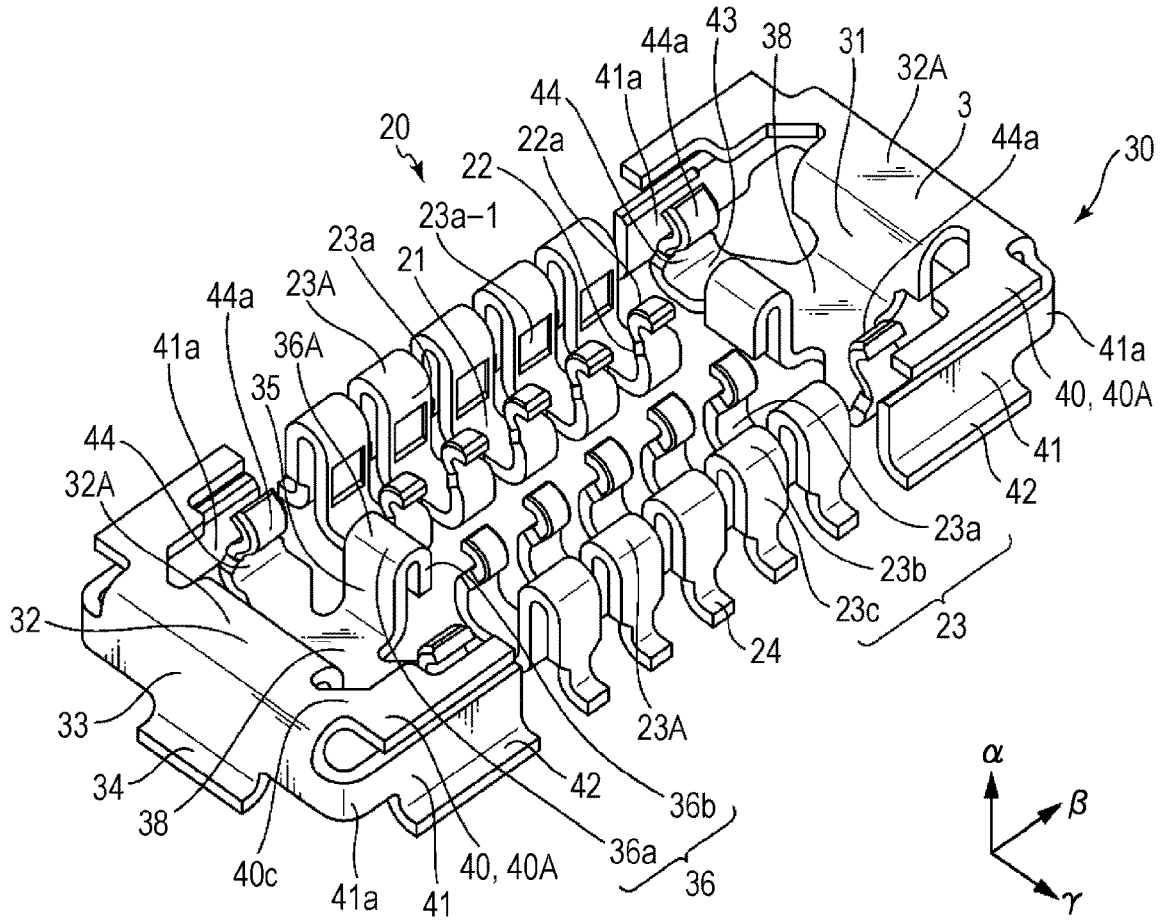
FIG. 3A is a perspective view illustrating terminals and reinforcing fittings of a receptacle connector.
Figure 3B:
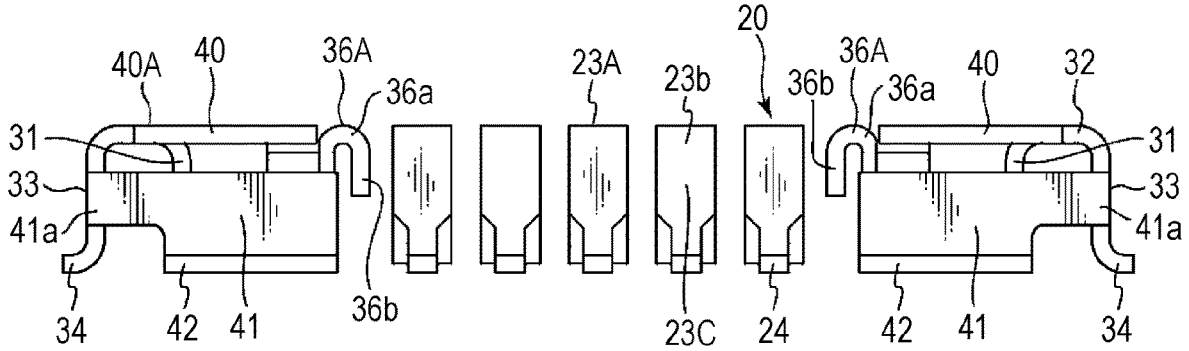
FIG. 3B is a side view of the same.
Figure 4:
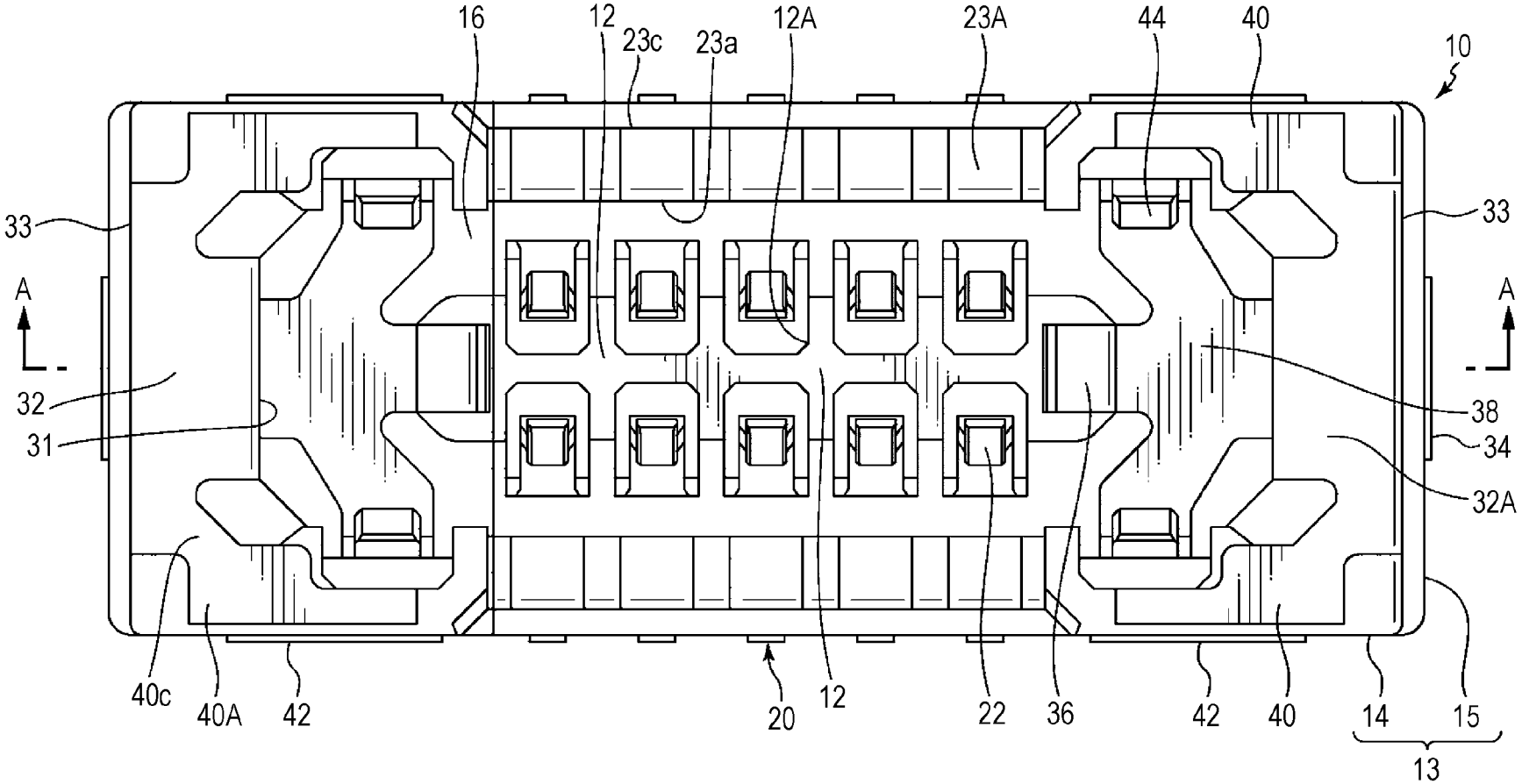
FIG. 4 is a plan view of a circuit board connector apparatus according to one embodiment of the present disclosure.
Figure 5:
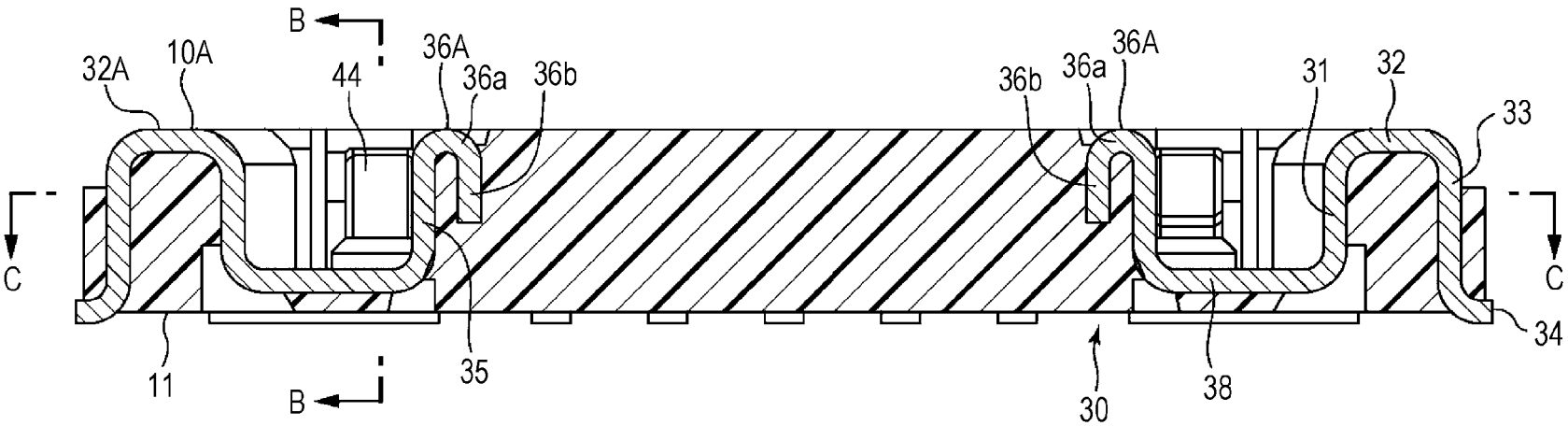
FIG. 5 is a cross-sectional view taken along line A-A of FIG. 4.
Figure 6:
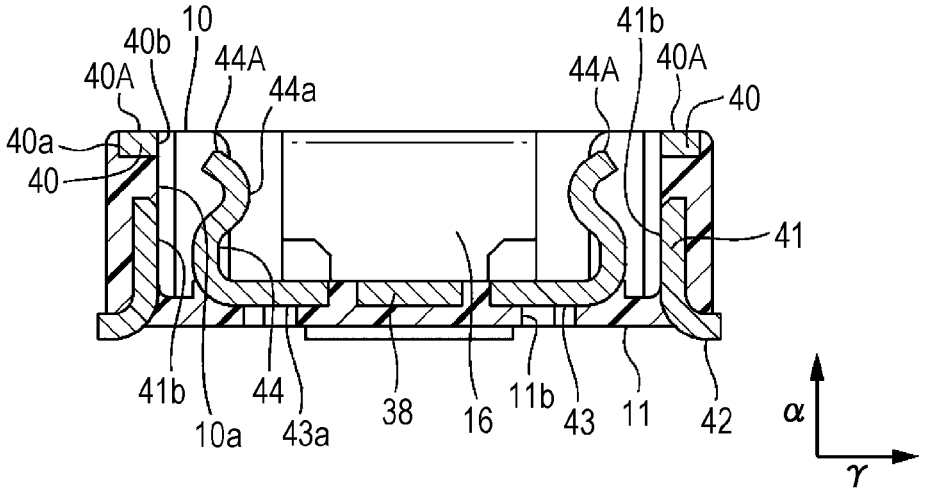
FIG. 6 is a cross-sectional view taken along line B-B of FIG. 5.
Figure 7:
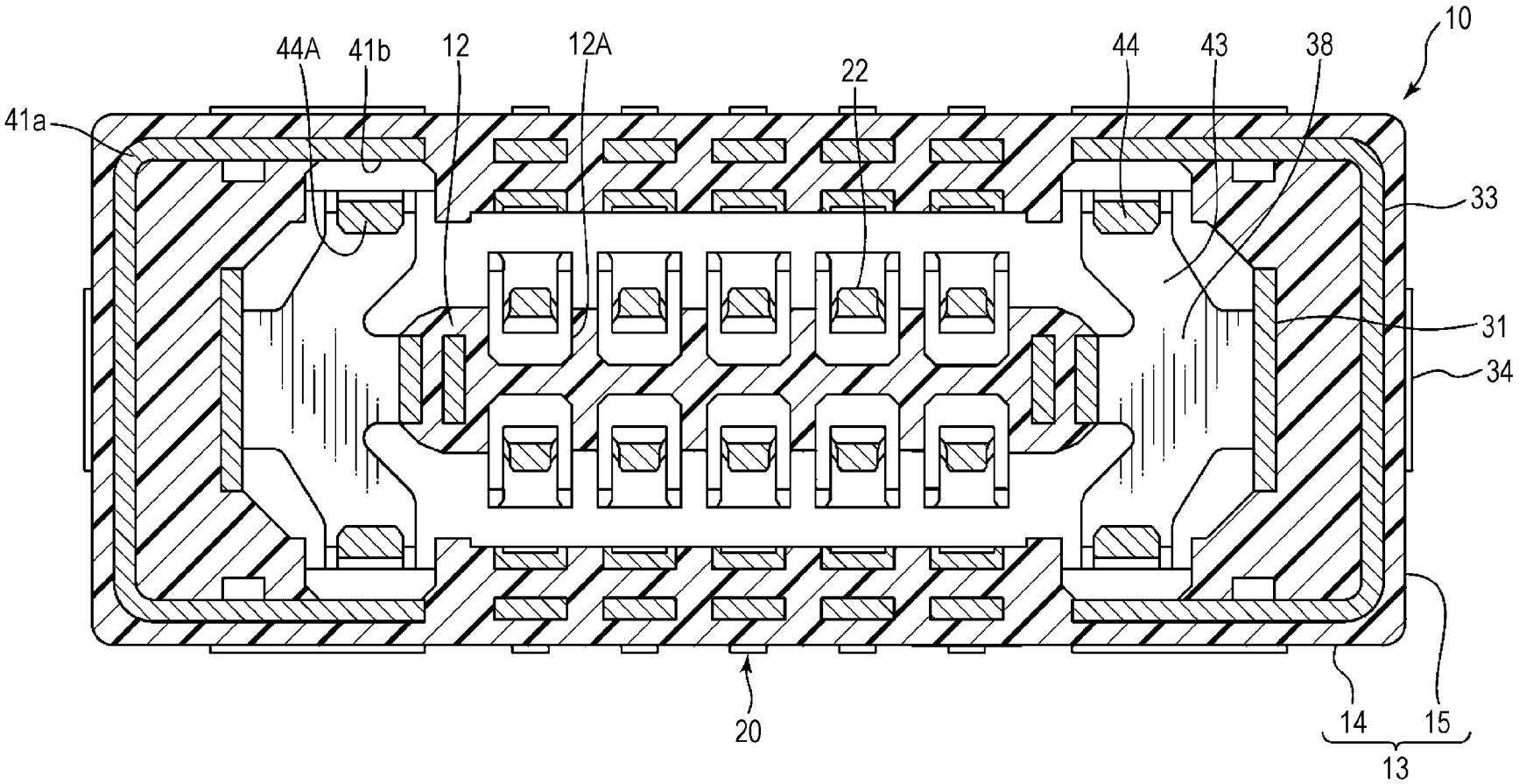
FIG. 7 is a cross-sectional view taken along line C-C of FIG. 5.

FIGS. 3A and 3B are diagrams illustrating the receptacle connector 1 illustrated in FIG. 1 and the like, and are diagrams where the housing 10 is omitted and only the terminals 20 and the reinforcing fittings 30 remain. FIG. 3A is a perspective view of the terminals 20 and the reinforcing fittings 30, and FIG. 3B is a side view of the same. Furthermore, FIG. 4 is a plan view illustrating only the receptacle connector 1. FIG. 5 is a cross-sectional view taken along line A-A of FIG. 4. FIG. 6 is a cross-sectional view taken along line B-B of FIG. 5. FIG. 7 is a cross-sectional view taken along line C-C of FIG. 5.

A total of 10 terminals 20 are provided, five on one side in the width direction "γ", and five on the other side across the protruding wall 12. The number of the terminals 20 is not particularly limited, and may be one. All the terminals 20 are placed in the length direction "β" at predetermined intervals within the area of the protruding wall 12.

The terminals 20 are mainly terminals used to transmit and receive signals. Each terminal 20 is formed by blanking a plate-shaped metal sheet and bending the blank. Each terminal 20 includes a base portion 21, a contact arm portion 22, an inverted U-shaped held portion 23, and a connecting portion 24. The contact arm portion 22 extends in the height direction "α" from one end of the base portion 21 toward the side mating with the plug connector 2. In other words, the contact arm portion 22 is caused to rise from the mounting surface side toward the side mating with the plug connector 2. The inverted U-shaped held portion 23 extends in the height direction "α" from the other end of the base portion 21 toward the side mating with the plug connector 2 and the mounting surface side. The connecting portion 24 can be soldered and connected to a mounting surface formed at an end portion of the held portion 23. The base portion 21 has a predetermined width in the length direction "β". Consequently, a hole 11*a* formed in the bottom of the housing 10 can be appropriately blocked by setting a die for positioning the terminal 20. As a result, intrusion of foreign matter from the board side can be prevented. The contact arm portion 22 is formed in such a manner as to be elastically deformable. A free end of the contact arm portion 22 is provided with an elastic contact portion 22*a*.

When the terminal 20 is held by the housing 10, the contact arm portion 22 is placed in the groove 12A provided in the protruding wall 12, as described above. On the other hand, the held portion 23 is placed at the side wall 14 on a side facing the contact arm portion 22 in the width direction "γ" in such a manner as to face the contact arm portion 22 across the receiving portion 16.

The elastic contact portion 22*a* is provided in such a manner as to elastically protrude in the width direction "γ" toward the receiving portion 16 in a state of being biased from the groove portion 12A provided in the protruding wall 12 toward one side wall 14 placed in such a manner as to face the groove portion 12A. The elastic contact portion 22*a* is positioned between the plug connector 2 and the protruding wall 12 in such a manner as to be able to come into elastic contact with the plug connector 2 upon mating of the receptacle connector 1 and the plug connector 2. Upon mating of the receptacle connector 1 and the plug connector 2 may be expressed below as upon mating with the plug connector 2.

The held portion 23 includes an inner arm portion 23*a*, a transitional portion 23*b*, and an external arm portion 23*c*. The inner arm portion 23*a* extends in the height direction "α" along an inner surface of the side wall 14 from an end portion of the base portion 21 on the side wall 14 side toward the side mating with the plug connector 2. The transitional portion 23*b* is continuous from an upper end of the inner arm portion 23*a*, and is folded back on itself in the height direction "α" toward the mounting surface side at a position outward of the inner arm portion 23*a* in the connector width direction. The external arm portion 23*c* extends in the height direction "α" from an end portion of the transitional portion 23*b* toward the mounting surface side. An exposed surface of the inner arm portion 23*a* is provided with a lock recessed portion 23*a*-1.

It is preferable that at least a part of the held portion 23 be exposed to the outside of the housing 10 even when the terminal 20 is held by the housing 10. Especially a part of the transitional portion 23*b* of the held portion 23 can form a top portion 23A of the terminal 20. The top portion 23A of the terminal 20 is exposed from the side wall 14 of the housing 10 on the side mating with the plug connector 2 in the height direction "α". The top portion 23A of the terminal 20 is located on a side closest in the height direction "α" to the plug connector 2. There is a high possibility that a portion forming the top portion 23A of the terminal 20 and its peripheral portion in the width direction "γ" collide with the plug connector 2 upon mating with the plug connector 2. It is preferable that these portions be exposed from the housing 10 on the side mating with the plug connector 2 in the height direction "α". Consequently, the metal portions with a higher strength than the resin housing 10 can be portions that may collide with the plug connector 2 upon mating with the plug connector 2. As a result, undesired breakage of the receptacle connector 1 can be prevented.

Figure 8:
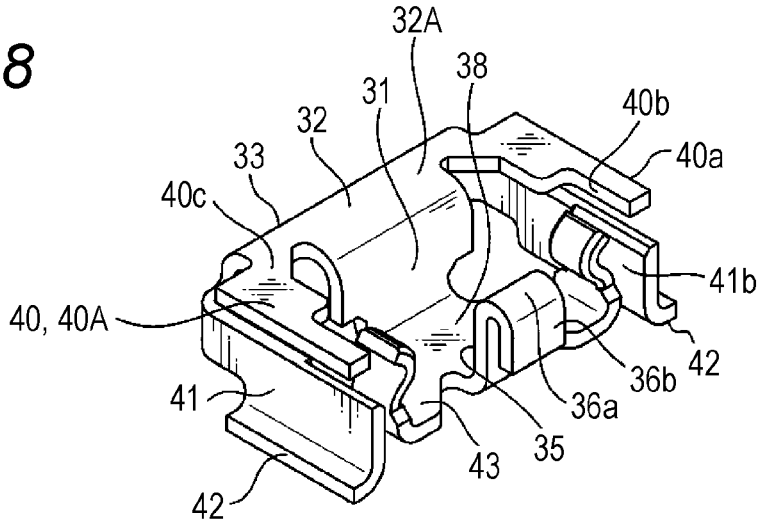
FIG. 8 is a perspective view of the reinforcing fitting.
Figure 9:
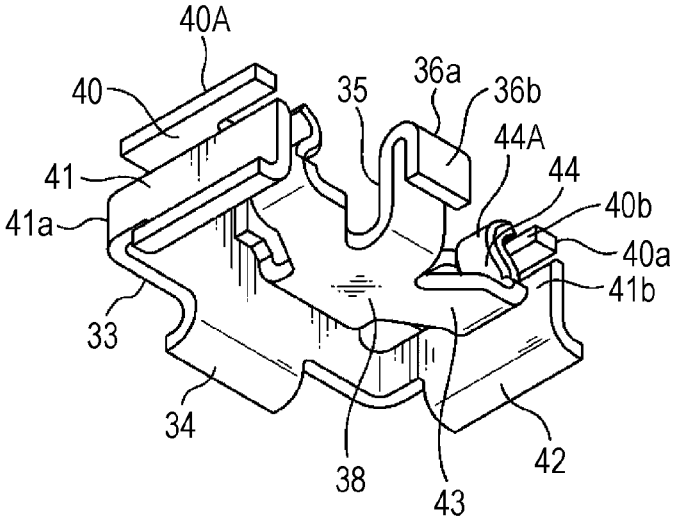
FIG. 9 is a perspective view of the reinforcing fitting.
Figure 10:
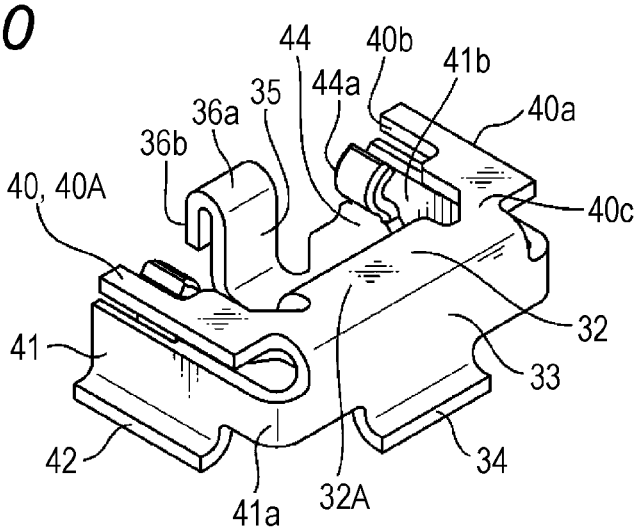
FIG. 10 is a perspective view of a perspective view of the reinforcing fitting.
Figure 11:
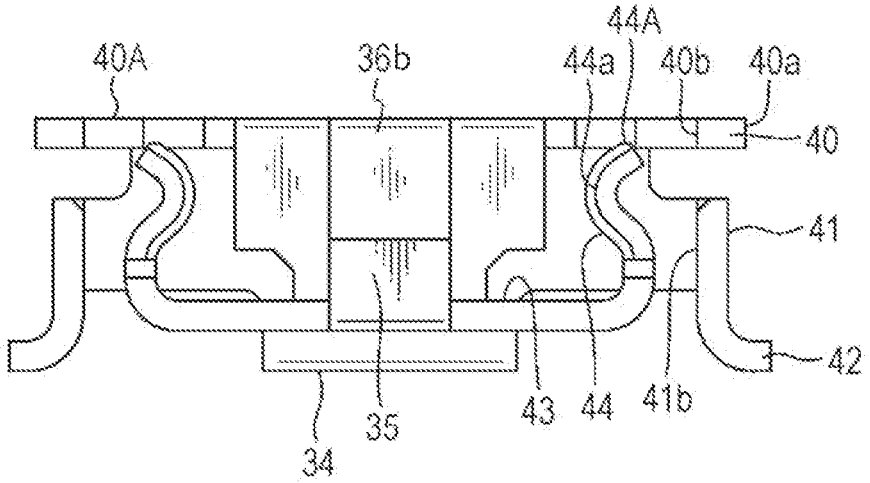
FIG. 11 is a front view of the reinforcing fitting.

FIGS. 8 to 10 are perspective views of the reinforcing fitting 30 as viewed from angles different from each other. Furthermore, FIG. 11 is a front view of the reinforcing fitting. The reinforcing fitting 30 has at least a function of reinforcing the strength of the housing 10. The reinforcing fitting 30 may further have a function as a power supply terminal by coming into mechanical and electrical contact with a reinforcing fitting 70 of the plug connector 2. The reinforcing fitting 30 is not always required to have a function as a power supply terminal. However, many advantages can be obtained by using the reinforcing fitting 30 as a power supply terminal.

A total of two reinforcing fittings 30 are provided, one at either end portion of the peripheral wall 13 in the length direction "β". Both of the reinforcing fittings 30 are placed outside the area of the protruding wall 12 in the length direction "β", except portions that can form a part of the protruding wall 12 (an end wall 35 and a bent portion 36*a*, which are described below).

The reinforcing fitting 30 is formed using a plate-shaped metal sheet. In other words, the reinforcing fitting 30 is formed by blanking a plate-shaped metal sheet and bending the blank. The reinforcing fitting 30 includes at least end portions (31, 32, and 33), a side wall top surface reinforcing portion (first portion) 40, and a rising portion (second portion) 41. Both of the side wall top surface reinforcing portion 40 and the rising portion 41 extend parallel toward the terminal 20 along the peripheral wall 13 in a state of being connected to the end portions (31, 32, and 33) and spaced apart in the height direction "α" from each other. More specifically, the side wall top surface reinforcing portion 40 and the rising portion 41 extend in the width direction "γ" along a part of the end wall 15, and extend in the length direction "β" along a part of the side wall 14.

The end portions include an external wall portion 33 forming an external wall of the end wall 15, an internal wall portion 31 forming an internal wall of the end wall 15, and an upper wall portion (end portion top surface reinforcing portion) 32. The upper wall portion 32 joins the external wall portion 33 and the internal wall portion 31 on the side mating with the plug connector 2 in the height direction "α".

The external wall portion 33 is provided in a state where substantially the entire part thereof is embedded in the housing 10 on the side of the mounting surface of the circuit board. An end portion of the external wall portion 33 is provided with a mounting portion 34 extending substantially parallel to a board surface of the circuit board.

The internal wall portion 31 can form a part of a surface of the receiving portion 16.

The upper wall portion 32 may form a flat plate surface on a plane "β-γ" orthogonal to the height direction "α" as illustrated in the embodiment. The flat surface forms a top portion 32A located on the side closest in the height direction "α" to the plug connector 2. The top portion 32A is provided in a state of being exposed from the housing 10. The top portion 32A has a predetermined width along the width direction "γ" of the peripheral wall 13. According to the above configuration, the possibility that the upper wall portion 32 collides with the plug connector 2 can be made substantially the same as, for example, a top portion 40A of the side wall top surface reinforcing portion 40. In addition, the portion with a high possibility of colliding with the plug connector 2 upon mating with the plug connector 2 can be made as a metal portion with a high strength all over the side wall 14 in the width direction "γ". Consequently, undesired breakage of the receptacle connector 1 can be prevented. Moreover, it is possible to effectively prevent the receptacle connector 1 from resulting in upsizing in the height direction "α". The other portion is provided in a state of being exposed from the housing 10 on a surface on the side mating with the plug connector 2.

The side wall top surface reinforcing portion 40 may form a flat plate surface on the plane "β-γ" orthogonal to the height direction "α", as illustrated in the embodiment. Consequently, the receptacle connector 1 can be downsized in the height direction "α". The flat surface forms the top portion 40A located on the side closest in the height direction "α" to the plug connector 2. The top portion 40A extends from the upper wall portion 32 in a state of being continuous across a connecting portion 40*c* to the top portion 32A of the upper wall portion 32. The top portion 40A, together with the top portion 32A, is exposed from the housing 10. It is preferable that the top portions 40A and 32A, together with a top portion 10A of the housing 10 and the top portion 23A of the terminal, be positioned at the same height in the height direction "α" as illustrated in the embodiment. There is a high possibility that the top portions 40A, 32A, 10A, and 23A collide with the plug connector 2 upon mating with the plug connector 2. It is preferable that these portions be exposed from the housing 10 on the side mating with the plug connector 2 in the height direction "α". Consequently, the metal portions with a higher strength than the resin housing 10 can be made as the portions that may collide with the plug connector 2 upon mating with the plug connector 2. As a result, undesired breakage of the receptacle connector 1 can be prevented.

The rising portion 41 is a portion extending in a state of being continuous across a bent portion 41*a* from the external wall portion 33. The rinsing portion 41 is positioned on a side closer in the height direction "α" to the mounting surface than the side wall top surface reinforcing portion 40, and at the same position as an outer end 40*a* of the side wall top surface reinforcing portion 40, or inward of the outer end 40*a* in the housing 10, in the width direction "γ". The side wall top surface reinforcing portion 40 and the rising portion 41 extend parallel to each other in a state of maintaining this positional relationship and each having a free end at a distal end. According to this configuration, the reinforcing fittings 30 are provided; accordingly, it is possible to prevent the receptacle connector 1 from resulting in upsizing in the width direction "γ". Furthermore, according to this configuration, the receptacle connector 1 can be downsized in the width direction "γ" as compared to the known configuration.

A side, which is opposite to the side mating with the plug connector 2 in the height direction "α", of the rising portion 41 is mounted on the mounting surface of the circuit board. A mounting portion 42 extending substantially parallel to the board surface of the circuit board is provided on the mounting surface side for the purpose of mounting on the circuit board.

At least a part of the rising portion 41 can form an exposed surface 41*b* exposed from the housing 10 on the receiving portion 16 side. The exposed surface 41*b* is formed by a surface extending in the height direction "α" and the length direction "β". Substantially the entire part of the rising portion 41, which includes the bent portion 41*a* extending from the external wall portion 33 except the exposed surface 41*b*, is embedded in the housing 10. If the reinforcing fitting 30 is insert-molded in the housing 10, at least the exposed surface 41*b*, an inner end 40*b* of the side wall top surface reinforcing portion 40, and a part 10*a* of the housing provided between them form the same surface along the height direction "α" on the receiving portion 16 side. Consequently, the receptacle connector 1 can be downsized in the width direction "γ". Moreover, they form the same surface; accordingly, the strength of the receptacle connector 1 can be increased.

Moreover, the reinforcing fitting 30 includes a bottom portion 38 forming a part of a bottom wall 51 of the receiving portion 16. The reinforcing fitting 30 further includes the end wall 35, and the bent portion 36*a* that is bent. The end wall 35 extends along the longitudinal direction "β" from the bottom portion 38. Furthermore, the end wall 35 protrudes in the height direction "α" toward the side mating with the plug connector 2, and forms a part of an external wall of the protruding wall 12. The bent portion 36*a* is provided to the end wall 35 on a side opposite to the bottom portion 38. The end wall 35 is located at an end portion of the protruding wall 12 in the length direction "β". The end wall 35 has a function of protecting an end surface of the protruding wall 12 upon mating with the plug connector 2. The bent portion 36*a* forms the top portion 36A of the protruding wall 12 located on the side closest in the height direction "α" to the plug connector 2. The top portion 36A is positioned at the same height in the height direction "α" as the top portion 23A formed at the transitional portion 23*b* of the terminal 20, and the top portion 40A of the side wall top surface reinforcing portion 40. Consequently, the top portion 36A, together with, for example, the top portion 40A, has a role (function) of reinforcing the resin housing 10, especially the protruding wall 12. The end portion 36*b* of the bent portion 36*a* is embedded in the protruding wall 12. Consequently, the reinforcing fitting 30 is effectively prevented from dropping easily from the housing 10.

Moreover, the reinforcing fitting 30 further includes extension portions 43 and narrow contact arm portions 44. The extension portions 43 extend from the bottom portion 38 in a state of branching in directions away from each other in the width direction "γ". The contact arm portion 44 protrudes in the height direction "α" from the bottom portion 38 toward the side mating with the plug connector 2 via the extension portion 43. In other words, the contact arm portion 44 is caused to rise from the mounting surface side toward the side mating with the plug connector 2. In this manner, the narrow contact arm portions 44 are branched away in the width direction "γ" from the relatively large bottom portion 38. Consequently, the generation of heat at the elastic piece can be effectively reduced. As a result, the reinforcing fitting 30 can also be used as a power supply terminal that can transmit high current. Moreover, the extension portion 43 has a predetermined width; accordingly, a hole 11*b* formed in the bottom of the housing 10 can be appropriately blocked by setting a die for positioning the reinforcing fitting 30. As a result, intrusion of foreign matter from the board side can be prevented. An elastic contact portion 44*a* is formed at a distal end of each contact arm portion 44. The elastic contact portion 44*a* is positioned between the plug connector 2 and the peripheral wall 13 in such a manner as to be able to come into elastic contact with the plug connector 2 upon mating with the plug connector 2.

A top portion 44A, which is located on the side closest in the height direction "α" to the plug connector 2, of the elastic contact portion 44*a* is located on the side closer to the mounting surface than the top portion 40A, which is located on the side closest in the height direction "α" to the plug connector 2, of the side wall top surface reinforcing portion 40. Consequently, the contact arm portion 44 can be effectively prevented from being buckled due to a collision with the plug connector 2 upon mating with the plug connector 2.

The elastic contact portion 44*a* is provided in such a manner as to elastically protrude in the width direction "γ" toward the receiving portion 16 in a state of being biased from one side wall 14 toward the other side wall 14 that is placed in such a manner as to face the one side wall 14. The elastic contact portion 44*a* is positioned between the plug connector 2 and the side wall 14 in such a manner as to be able to come into elastic contact with the plug connector 2 upon mating of the receptacle connector 1 and the plug connector 2.

The elastic contact portions 44*a* are arranged along the length direction "β" as in the elastic contact portions 22*a*. However, unlike the elastic contact portions 22*a*, the elastic contact portions 44*a* do not reach, in the length direction "β", the area of the protruding wall 12 where the elastic contact portions 22*a* are arranged. Therefore, the receptacle connector 1 is not substantially upsized in the length direction "β" due to the provision of the elastic contact portions 44*a*.

The elastic contact portion 22*a* and the elastic contact portion 44*a* are placed in the receiving portion 16 of the housing 10 in such a manner as to face each other in the width direction "γ". Moreover, the direction in which the elastic contact portion 44*a* protrudes elastically and the direction in which the elastic contact portion 22*a* protrudes elastically are set in directions opposite to each other in the width direction "γ". As a result, a gap into which a predetermined portion of the plug connector 2 is elastically inserted is formed in the width direction "γ" between the elastic contact portion 22*a* and the elastic contact portion 44*a*. The predetermined portion (for example, the side wall 54) of the plug connector 2 is elastically inserted into the gap; accordingly, the elastic contact portion 22*a* of the terminal 20 can come into elastic contact with the predetermined portion of the plug connector 2 between the plug connector 2 and the protruding wall 12, that is, on the internal wall side of the plug connector 2. On the other hand, the elastic contact portion 44*a* of the reinforcing fitting 30 can come into elastic contact with the predetermined portion of the plug connector 2 between the plug connector 2 and the peripheral wall 13, that is, on the external wall side of the plug connector 2.

The elastic contact portion 44*a* is placed in a state of facing the exposed surface 41*b* of the rising portion 41 in the width direction "γ". Moreover, the exposed surface 41*b* and the elastic contact portion 44*a* have portions overlapping each other in the length direction "β". Such a configuration and placement allow, for example, effectively releasing the heat generated near the elastic contact portion 44*a* via the rising portion 41 through the mounting portion 42 continuous to the rising portion 41 when the reinforcing fitting 30 is used as a power supply terminal. The elastic contact portion 44*a* is narrower than the other portion. Accordingly, heat tends to be generated at the elastic contact portion 44*a*. However, the above mechanism allows effectively releasing the heat generated especially at the elastic contact portion 44*a*. Moreover, deformation of the elastic contact portion 44*a* due to, for example, buckling upon mating with the plug connector 2 can be effectively prevented.

The plug connector 2 includes a resin housing 50 of a substantially cuboid outer shape, and terminals 60 and reinforcing fittings 70, which are held by the housing 50. The holding of the terminals 60 and the reinforcing fittings 70 by the housing 50 may be holding by integration, or preferably holding by integral molding.

The housing 50 forms a box-shaped mating portion corresponding to the receiving portion 16 provided to the housing 10 of the receptacle connector 1. The housing 50 is fitted in the receiving portion 16 to mate and connect the receptacle connector 1 and the plug connector 2.

The housing 50 mainly includes a bottom wall 51, and a box-shaped peripheral wall 53. The bottom wall 51 is placed on the mounting surface where the circuit board is mounted. The peripheral wall 53 protrudes in the height direction "α" from the bottom wall 51 toward a side, which mates with the receptacle connector 1, of the plug connector 2. The side, which mates with the receptacle connector 1, of the plug connector 2 may be expressed below as the side mating with the receptacle connector 1.

The peripheral wall 53 includes two side walls 54, and two end walls 55. The side walls 54 face each other in the width direction "γ", and extend parallel along the length direction "β". Similarly, the end walls 55 face each other in the length direction "β", and extend parallel along the width direction "γ".

The plug connector 2 is also provided with a plurality of the terminals 60 corresponding to the terminals 20 of the receptacle connector 1. Each terminal 60 includes a U-shaped portion 61 of a U-shape held by the side wall 54, and a connecting portion 62. The connecting portion 62 extends outward in the width direction "γ" from one of two arm portions of the U-shaped portion 61, the one being located on a receiving portion 56 side, and is connected to a corresponding signal circuit portion of the circuit board.

The U-shaped portion 61 is a portion fitted between the contact arm portion 22 of the terminal 20 of the receptacle connector 1 and the inner arm portion 23*a* of the held portion 23 in a connector mated state. The U-shaped portion 61 is embedded in the side wall 54 in such a manner as to straddle the side wall 54 from below. The U-shaped portion 61 includes an outer arm portion 61*a*, a transitional portion 61*b*, and an inner arm portion 61*c*. The outer arm portion 61*a* extends toward the mounting surface side along an outer surface of the side wall 54. The transitional portion 61*b* is folded back on itself in the height direction "α" from a lower end of the outer arm portion 61*a* toward the side mating with the receptacle connector 1 at a position inward in the connector width direction. The inner arm portion 61*c* extends in the height direction "α" from an end portion of the transitional portion 61*b* toward the side mating with the receptacle connector 1. An exposed surface of the outer arm portion 61*a* is provided with a locked step portion 61*a*-1 corresponding to the lock recessed portion 23*a*-1 of the terminal 20 of the receptacle connector 1. The locked step portion 61*a*-1 latches in the lock recessed portion 23*a*-1 upon mating of the receptacle connector 1 and the plug connector 2. Consequently, the terminals 20 and 60 excellently come into contact with each other, and can prevent the connector from coming out.

A total of two reinforcing fittings 70 are provided, one on either end portion of the peripheral wall 53 in the length direction "β", corresponding to the reinforcing fittings 30 of the receptacle connector 1. The reinforcing fitting 70 has a function of reinforcing the housing 50, the function corresponding to the function of the reinforcing fitting 30 of the receptacle connector 1. The reinforcing fitting 70 may have a locking function of locking the reinforcing fitting 30 of the receptacle connector 1, and a function as a power supply terminal that comes into contact with the contact arm portion 44 of the reinforcing fitting 30 and is brought into electrical conduction with the reinforcing fitting 30.

The technology of the present disclosure is not limited to the above-mentioned embodiment. The technology of the present disclosure can be variously modified in such a manner as to differ from the above-mentioned embodiment.

Moreover, expressions such as "orthogonal", "horizontal", "vertical", "same", and "identical" in the specification include not only their strict meanings but also meanings of "substantially orthogonal," "substantially horizontal," "substantially vertical," "substantially the same", and "substantially identical."

The above description relates to the preferred embodiment, and should be understood that the description is simply representative of the article. It can be granted that modifications and amendments as different embodiments will become clear easily to those skilled in the art in light of the above-mentioned instructions. Therefore, an illustrative embodiment and an alternative embodiment can be realized without departing from the spirit of the article described in the accompanying claims.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A circuit board connector apparatus comprising:

a housing including a height direction, a length direction, and a width direction, which are orthogonal to each other; and a terminal and a reinforcing fitting, which are held by the housing, wherein the housing includes:

a protruding wall protruding in the height direction from a side of a mounting surface of a circuit board where the circuit board connector apparatus is mounted toward a side mating with a counterpart connector;

a peripheral wall including a length portion extending along the length direction, and a width portion extending along the width direction, the peripheral wall protruding in the height direction from the mounting surface side toward the side mating with the counterpart connector, the peripheral wall surrounding a perimeter of the protruding wall; and a receiving portion between the protruding wall and the peripheral wall in the length direction and the width direction, the receiving portion being recessed in the height direction from the side mating with the counterpart connector toward the mounting surface side, the reinforcing fitting includes a first and a second portion extending toward the terminal along at least the length portion of the peripheral wall in a state of each being connected to an end portion placed in the width portion of the peripheral wall and in a state of being spaced apart in the height direction from each other, the first portion is exposed from the housing on the side mating with the counterpart connector in the height direction, the second portion on a side opposite to the side mating with the counterpart connector in the height direction is mounted on the mounting surface of the circuit board, and the second portion is located on a side closer in the height direction to the mounting surface than the first portion, and at the same position as an outer end of the first portion, or inward of the outer end in the housing, in the width direction.

2. The circuit board connector apparatus according to claim 1, wherein the end portion includes:

an external wall portion forming an external wall of the width portion of the peripheral wall;

an internal wall portion forming an internal wall of the width portion of the peripheral wall, the internal wall portion facing the receiving portion; and an upper wall portion joining the external wall portion and the internal wall portion on the side mating with the counterpart connector in the height direction, and the upper wall portion is exposed from the housing on the side mating with the counterpart connector in the height direction.

3. The circuit board connector apparatus according to claim 2, wherein the first portion extends from the upper wall portion, and the second portion extends from the external wall portion.

4. The circuit board connector apparatus according to claim 2, wherein a top portion, which is located on a side closest in the height direction to the counterpart connector, of the upper wall portion is positioned at the same height in the height direction as a top portion, which is located on the side closest in the height direction to the counterpart connector, of the first portion.

5. The circuit board connector apparatus according to claim 4, wherein the second portion includes a surface formed in such a manner as to extend in the height direction and the length direction, and at least a part of the surface is exposed from the housing on the receiving portion side.

6. The circuit board connector apparatus according to claim 5, wherein at least a part of a surface of the second portion, the part being exposed from the housing, an inner end of the first portion, and a part of the housing provided between the part and the inner end form the same surface along the height direction on the receiving portion side.

7. The circuit board connector apparatus according to claim 1, wherein the reinforcing fitting further includes:

a bottom portion forming a part of a bottom wall of the receiving portion;

an end wall extending along the longitudinal direction from the bottom portion, the end wall protruding in the height direction toward the side mating with the counterpart connector, the end wall forming a part of an external wall of the protruding wall; and a bent portion on a side opposite to the bottom portion of the end wall.

8. The circuit board connector apparatus according to claim 7, wherein the bent portion forms a top portion, which is located on a side closest in the height direction to the counterpart connector, of the protruding wall.

9. The circuit board connector apparatus according to claim 7, wherein an end portion of the bent portion is embedded in the protruding wall.

10. The circuit board connector apparatus according to claim 7, wherein a part of the terminal is exposed from the length portion of the housing on the side mating with the counterpart connector in the height direction, and a top portion, which is located on a side closest in the height direction to the counterpart connector, of the terminal in the exposed part of the terminal is positioned at the same height in the height direction as a top portion of the bent portion and a top portion of the first portion, the top portions being located on the side closest in the height direction to the counterpart connector.

11. The circuit board connector apparatus according to claim 10, wherein an elastic contact portion of the terminal is positioned between the counterpart connector and the protruding wall in such a manner as to be able to come into elastic contact with the counterpart connector upon mating with the counterpart connector.

12. The circuit board connector apparatus according to claim 1, wherein the reinforcing fitting further includes:

a bottom portion forming a part of a bottom wall of the receiving portion; and an elastic contact portion extending along the width direction from the bottom portion, the elastic contact portion protruding in the height direction toward the side mating with the counterpart connector, and the elastic contact portion is positioned between the counterpart connector and the peripheral wall in such a manner as to be able to come into elastic contact with the counterpart connector upon mating with the counterpart connector.

13. The circuit board connector apparatus according to claim 12, wherein a top portion, which is located on a side closest in the height direction to the counterpart connector, of the elastic contact portion is located on a side closer to the mounting surface than a top portion, which is located on the side closest in the height direction to the counterpart connector, of the first portion.

14. The circuit board connector apparatus according to claim 12, wherein the second portion includes an exposed surface formed in such a manner as to extend in the height direction and the length direction, the exposed surface being exposed from the housing on the receiving portion side, and the elastic contact portion is placed in such a manner as to face the exposed surface of the second portion in the width direction.

15. The circuit board connector apparatus according to claim 14, wherein the exposed surface and the elastic contact portion each include a portion overlapping each other in the length direction.

16. The circuit board connector apparatus according to claim 1, wherein a top portion, which is located on a side closest in the height direction to the counterpart connector, of the first portion is positioned at the same height in the height direction as a top portion, which is located on the side closest in the height direction to the counterpart connector, of the housing.

17. The circuit board connector apparatus according to claim 1, wherein the terminal and the reinforcing fitting are integrally molded with the housing.

18. The circuit board connector apparatus according to claim 1, wherein the reinforcing fitting is formed, using one plate-shaped metal sheet.

19. A connector apparatus assembly comprising a pair of the circuit board connector apparatus according to claim 1 and the counterpart connector configured to mate with the circuit board connector apparatus.

* * * * *